US006651289B2

(12) United States Patent
Suzuki et al.

(10) Patent No.: US 6,651,289 B2
(45) Date of Patent: Nov. 25, 2003

(54) BRUSH

(76) Inventors: Masahiro Suzuki, 204-64, Suzukicho 2-chome, Kodaira-shi, Tokyo (JP); Toshio Kinoshita, 293-7, Oyahongo, Ageo-shi, Saitama-ken (JP); Atsushi Miyaoka, 22-15-1010, Oji 1-chome, Kita-ku, Tokyo (JP)

( * ) Notice: Subject to any disclaimer, the term of this patent is extended or adjusted under 35 U.S.C. 154(b) by 0 days.

(21) Appl. No.: 09/761,131

(22) Filed: Jan. 16, 2001

(65) Prior Publication Data

US 2002/0046436 A1 Apr. 25, 2002

(30) Foreign Application Priority Data

Jan. 18, 2000 (JP) ..... 2000-008551

(51) Int. Cl.[7] ..... A46B 11/00

(52) U.S. Cl. ..... 15/168; 15/114; 15/248.1; 15/160

(58) Field of Search ..... 15/114, 168, 160, 15/169, 248.1

(56) References Cited

U.S. PATENT DOCUMENTS

| | | | | | |
|---|---|---|---|---|---|
| 530,386 | A | * | 12/1894 | Boecha | 15/168 |
| 634,570 | A | * | 10/1899 | Briggs | 15/168 |
| 700,263 | A | * | 5/1902 | Traub | 15/168 |
| 2,070,448 | A | * | 2/1937 | Nork | 15/168 |
| 3,205,524 | A | * | 9/1965 | Stormyr | 15/168 |
| 5,088,950 | A | * | 2/1992 | LaFata | 15/168 |

FOREIGN PATENT DOCUMENTS

| | | |
|---|---|---|
| JP | 1992-120627 | 10/1992 |
| JP | 1992-131323 | 12/1992 |
| JP | 1994-84927 | 12/1994 |

* cited by examiner

*Primary Examiner*—Randall E. Chin
(74) *Attorney, Agent, or Firm*—Zito tlp; Joseph J. Zito; Kendal M. Sheets

(57) ABSTRACT

A brush is provided in which a brush body is formed with a circumference of a fur bundle being surrounded with a fabric material and a tip end face of the fur bundle being extruded and exposed.

3 Claims, 6 Drawing Sheets

BRUSH

BACKGROUND OF THE INVENTION

The present invention relates to an improvement in a brush that may be applied for coating and may be applied to various fields for cleaning, polishing or the like, and more particularly to a brush that is suitable for working with a sufficient amount of fluid material impregnated.

Conventionally, a brush for coating, cleaning and polishing is made of bundled and fixed fur material such as natural fur and synthetic resin filaments or such as foamed resin having continuous pores and fibrous material.

In the case where the brush made of bundled fur material is used for coating, it is possible to apply the brush to corrugated surfaces such as woody patterns by using a tip end of the fur material. On the other hand, a large amount of impregnated coating material is released due to deformation of the tip end of the fur material particularly in case of the coating material having a low viscosity and a high fluidization to generate a coating track or a liquid drop due to the low liquid impregnation property. Thus, it is disadvantageously difficult for unskilled persons to handle the brush in a proper manner.

In the case where the brush made of bundled fur material is used for cleaning or polishing, due to the low impregnation property of cleaning liquid or polishing liquid, the impregnated liquid material is released quickly in a short period after the working operation. Also, due to the poor contact stability of the brush to the cleaning surface or the polishing surface, it is impossible to effectively achieve the cleaning or polishing work.

Therefore, Japanese Utility Model Application Laid-Open No. 84927/1994 discloses a brush that is superior in contactability to the coating or cleaning surface with a high liquid impregnation ability and in which a brush portion serving to clean or coat is formed of super fine fibrous material.

However, since the above-described brush portion is made of fabric material, it is suitable for the cleaning tool such as a mop or the like to use with the cleaning liquid but is not suitable for the coating brush that needs a proper rigidity.

Also, Japanese Utility Model Application Laid-Open No. 120627/1992 discloses a brush in which brush material made of super fine fiber is implanted in a brush portion and conventional brush fur is implanted around it for reinforcing an insufficient rigidity of the brush material, The brush with this structure is suitable for mainly polishing teeth or claws by utilizing the contactability of the super fine fiber but the brush portion does not have a high liquid impregnation ability. From view point of the coating brush, easy handling and application to coating surface are not considered at all.

Also, Japanese Utility Model Application Laid-Open No. 131323/1992 discloses a brush in which the fabric material made of super fine fiber covers a brush portion formed of cushion material in a tooth brush. This type brush may be used suitable for tooth brushing but it is impossible to well apply the brush to the corrugated portions having irregular convex or concave portions such as a woody pattern like a brush whose tip end may be utilized well. In the application of this type of the brush, the coating surface is very limited as a coating brush.

Also, in another conventional brush, a metal is used to bundle the fur or brush material. Since the metal is short and hard and almost all the portion of the brush material is extruded and exposed and kept free. Accordingly, this type conventional brush has substantially the same disadvantages as those of the foregoing conventional brushes.

SUMMARY OF THE INVENTION

In view of the foregoing defects inherent in the conventional art, an object of the present invention is to provide a brush that performs well with various coating fields with high liquid impregnation ability and high rigidity and that is suitable for other fields such as cleaning or polishing work in which a brush is used with a sufficient amount of fluid material being impregnated.

According to a first aspect of the present invention, in order to attain the above mentioned object, there is provided a brush body characterized in that a circumference of a fur bundle is surrounded with a fabric material and a tip end face of the said fur bundle is extruded and exposed.

Thus, the liquid impregnation ability of the brush body is enhanced and the deformation of the fur bundle in use is lessened to hold the low viscosity solution well. Accordingly, brush marks and drips are prevented, and the working area by one operation is enlarged. It is possible to provide a brush whose tip may be used well with suitable rigidity.

Also, according to a second aspect of the invention, a brush is characterized in that a brush segment is formed with a circumference of a fur bundle being surrounded with a fabric material and a tip end face of the fur bundle being protruded and exposed, and a plurality of the said brush segments are implanted in a base to form a brush body.

Thus, the liquid impregnation ability of the brush segments is enhanced. The rigidity is enhanced and the brush tip and the fabric portion are brought into intimate contact with the working surface. The brush has a strong scraping force for cleaning and the brush allows for the application of sufficient pressure so that fine polishing is effectively performed.

Also, the fabric material is that made of super fine threads whereby the liquid impregnation ability is further enhanced and the contactability to the working surface is enhanced to more effectively perform the coating, cleaning and polishing work.

BRIEF DESCRIPTION OF THE INVENTION

DESCRIPTION OF THE PREFERRED EMBODIMENTS

A brush according to a preferred embodiment of the invention will now be described in detail with reference to the accompanying drawings.

Figure 1:
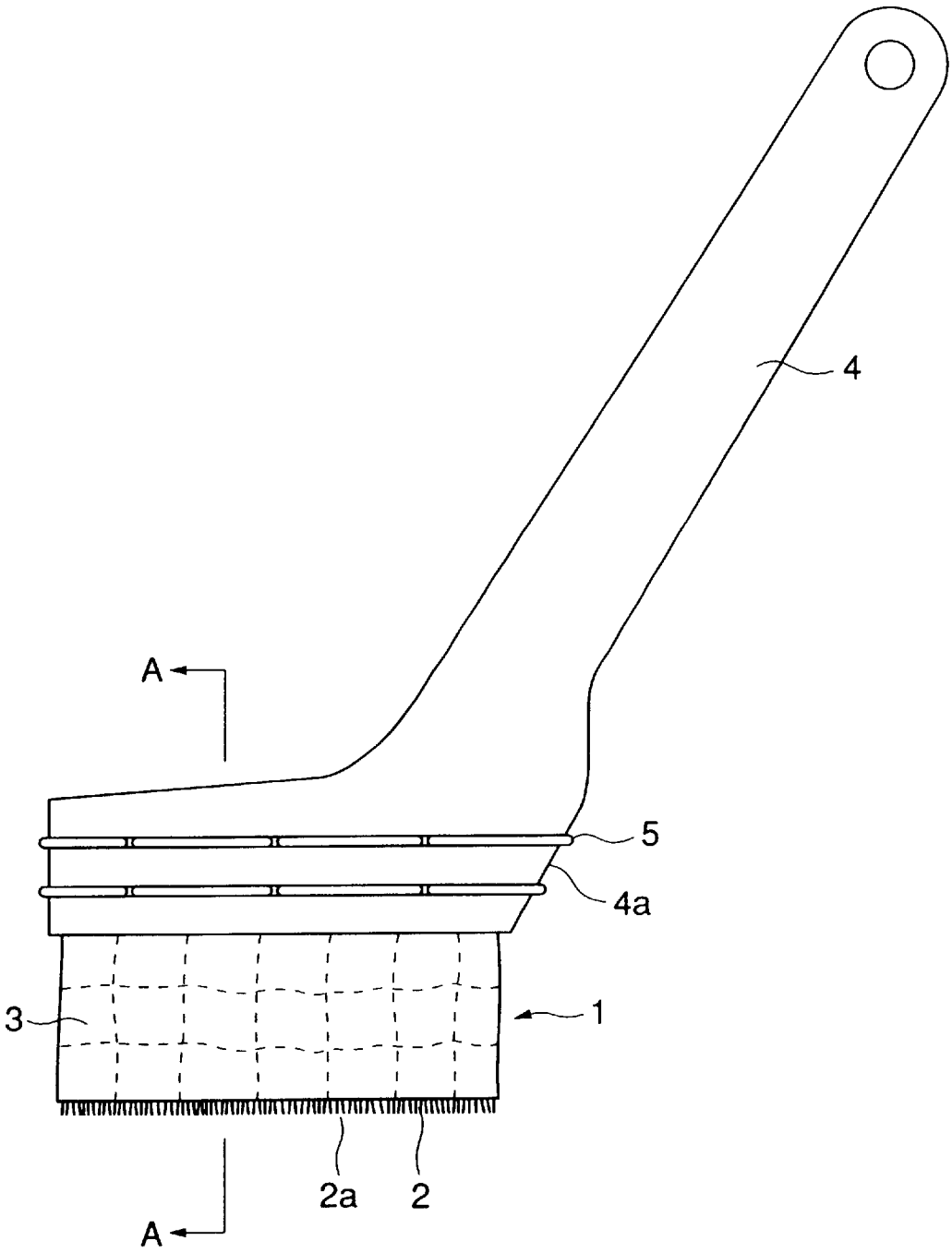
FIG. 1 is a frontal view showing a brush according to a first embodiment of the invention.
Figure 2:
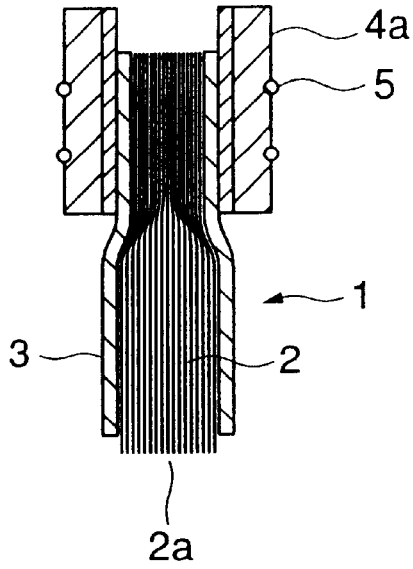
FIG. 2 is a cross-sectional view showing the brush taken along the line A—A of FIG. 1.
Figure 3:
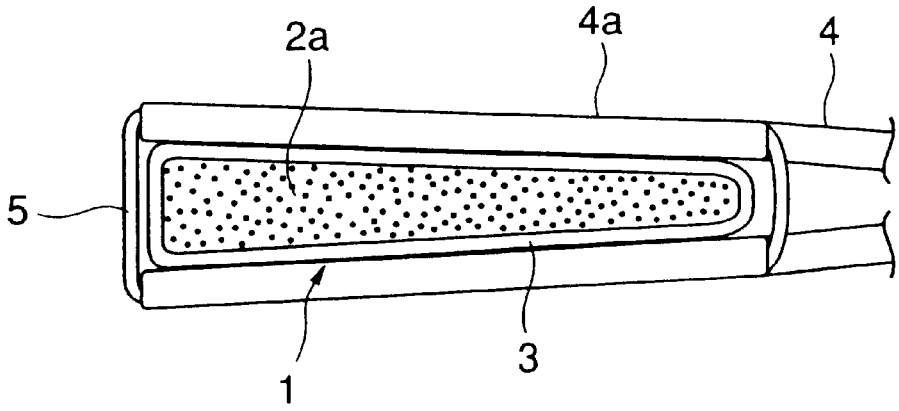
FIG. 3 is a bottom view showing a primary part of the brush shown in FIG. 1.

FIGS. 1 to 3 show a first embodiment of the invention in which a fur bundle 2 is surrounded with a liquid absorbing fabric material 3, a tip end face 2*a* of the fur bundle 2 is extruded and exposed to form a brush body 1 and an upper portion of the brush body 1 is clamped with a lower end portion 4*a* of a brush handle 4 and fastened and fixed with fastening wire 5. This brush is suitable for coating.

The fur material of the fur bundle 2 constituting the brush body 1 of this brush is made of chemical fiber such as polyamide or polyester or natural fiber such as natural fur or plant fiber being used generally for a brush.

The fabric material 3 is made of super fine fiber of polyester, acryl, polyamide or mixture of these materials that is woven with super fine threads having one denier or less or that is non-woven material using super fine threads.

The fabric material of super fine threads is superior in liquid absorbing property and liquid holding property due to a capillary phenomenon based upon the denseness of the super fine threads and has a high contactability to the coating surface, the polishing surface, the cleaning surface or the like based upon the fact that the material threads are super fine.

The brush body 1 in accordance with this embodiment is formed in a manner that the circumference of the fur bundle 2 is surrounded with the fabric material 3 of the super fine fiber and both ends of the fabric material 3 are stitched to form the fabric material 3 into a sleeve or the circumference of the fur bundle 2 is wound around with a fabric cut into a strip by one or more rounds and the fabric ends are stitched, with the tip end face 2*a* of the fur bundle 2 being extruded and exposed.

When this brush is used as a coating brush, it has a high rigidity due to the fur bundle 2 and the deformation of the fur bundle 2 is lessened by winding around with the super fine fabric material 3. Therefore, it is possible to hold the coating material by the fur bundle 2. Also, since the coating material may be well held by the fabric material 3 per se on the basis of the height of liquid absorption generated by the capillary phenomenon in the super fine threads, the coating material impregnation ability is extremely high in comparison with the conventional coating brush. Accordingly, in particular, it is superior in holding property of coating material having a high fluidization and a low viscosity and has a liquid drop preventing effect. It is possible to perform the coating work for a wide working surface at one brush operation.

Also, since the tip end face 2*a* of the fur bundle 2 of the brush body 1 is protruded and exposed, it is possible to apply the brush to the irregular corrugation surfaces such as a woody pattern by using the fur tip. And in addition, since an impregnation amount of the coating material is large, it is possible to release the impregnated coating material with a small force to the brush body 1.

An extra amount of the coating material discharged from the fur bundle 2 during the working operation is absorbed and held in the fabric material 3. Thereafter, the coating material is discharged uniformly. Accordingly, it is possible to perform the coating operation with a uniform brushing work, and the portion of the fabric material 3 is brought into intimate contact with the working surface for coating by the operation of the brush. Therefore, it is possible to form a smooth coated surface without any brushing pattern. Accordingly, this may provide a brush that may readily be handled even by an unskilled person.

Figure 4:
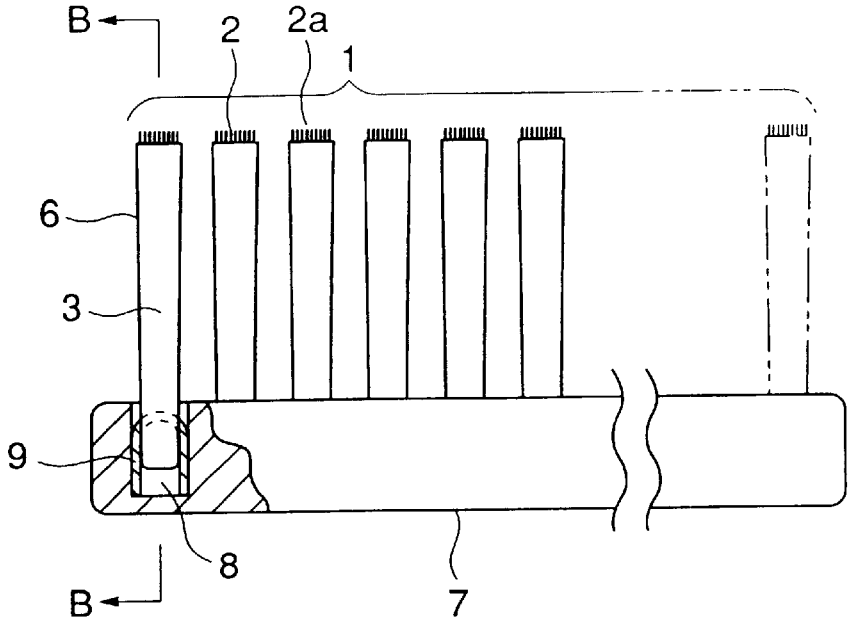
FIG. 4 is a fragmentary sectional frontal view showing the brush according to a second embodiment of the invention.
Figure 5:
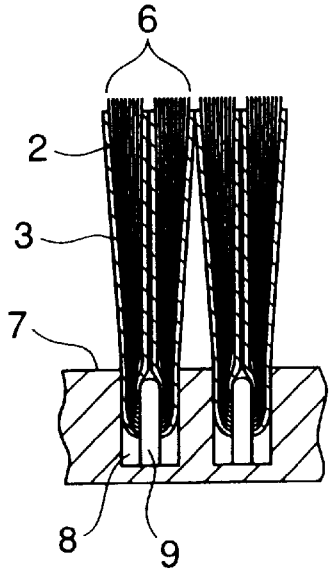
FIG. 5 is a cross-sectional view showing the brush taken along the line B—B of FIG. 4.
Figure 6:
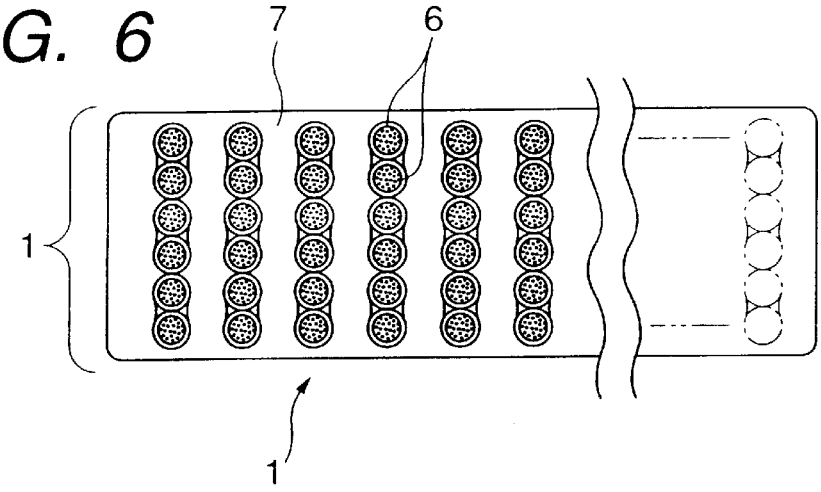
FIG. 6 is a plan view of the brush shown in FIG. 4.

FIGS. 4 to 6 show a second embodiment of the invention where a brush segment 6 is formed with the circumference of the fur bundle 2 being wound with a liquid absorbing fabric material 3 and a tip end face 2*a* of the fur bundle 2 being extruded and exposed and a plurality of the said brush segments 6 are implanted into a brush base 7 to form a brush body 1. This brush is suitable for cleaning and polishing.

The fur bundle 2 of the brush segment 6 constituting this brush body 1 may be made of plant fiber in addition to natural fur or synthetic resin filaments.

Also, in the same manner as in the foregoing embodiment, the fabric material 3 may be formed of a super fine fiber woven with super fine threads or a non-woven material using the super fine threads.

In order to form the brush segment 6, the fur bundle 2 is formed with fur material having a long length, the circumference of the fur bundle 2 is wound to be sleeved or wound around by one or more rounds with the fabric material 3 having a wide width of super fine fabric to form a brush segment 6 having a long dimension and the obtained one is cut into a predetermined dimension to make a brush segment 6 having a predetermined length with the tip end face 2*a* of the fur bundle 2 being extruded and exposed on both sides.

In the brush body 1 according to this invention, the above-described brush segment 6 being folded in two is implanted into each of mounting holes 8 formed at a suitable interval in a plural number on a brush base 7 and is fixed by using an inverted U-shaped fastening member 9.

Incidentally, the brush segment 6 is not limited to that mentioned above but a plurality of yarned fur bundles 2 may be wrapped with the fabric material 3. Also, a plurality of thin brush segments 6 may be further surrounded with the fabric material 3 to form a single brush segment 6 (not shown). In brief, it is important to surround the fur bundle 2 with the fabric material 3 while exposing the tip end face of the fur bundle 2.

Also, the shape of the brush base 7 is not limited to that shown in the drawings. It is possible to form the brush base 7 into a roll, and to implant the brush segments 6 in the surface of the roll to form a brush in which a roll-shaped brush body 1 is formed (not shown).

In the brush according to the embodiment, the liquid impregnation ability of the brush segment is high and it is possible to hold cleaning or polishing liquid within the brush segment in the quantity for longer work time in comparison with the conventional brush to increase the work volume to be made in single working operation.

Also, the brush body 1 has rigidity and the fur tip and the fabric material may be used. Accordingly, when the brush is used as a cleaning brush, the brush may strongly effect a working surface for cleaning having the corrugations and a stain may well be entrained by the fabric material 3 of the super fine fiber with a high void rate. It is therefore ensure the high cleaning effect.

Also, when the brush is used as a polishing brush, the polishing agent is held well and the fur tip end and the fabric portion that has high rigidity are well applied to the working surface for polishing. Accordingly, strong and fine polishing may be performed effectively.

Figure 7:
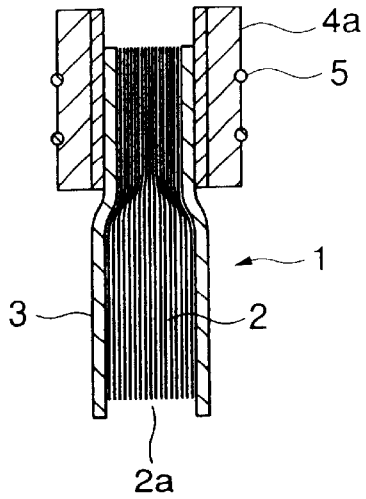
FIG. 7 is a cross-sectional view showing a primary part according to another embodiment.
Figure 8:
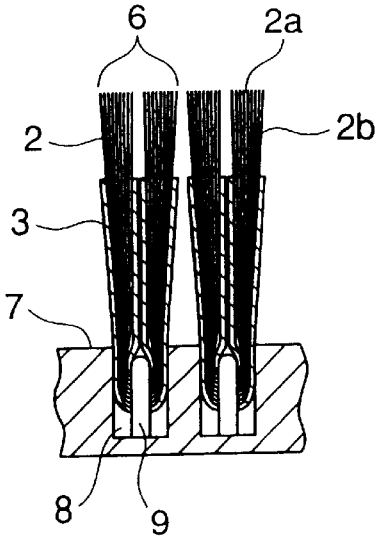
FIG. 8 is a cross-sectional view showing a primary part according to another embodiment.

Incidentally, as shown in FIG. 7, the brush body 1 and the brush segment 6 of the brush according to the invention may be formed so that the tip end face 2*a* of the fur bundle 2 is slightly retracted from the fabric material 3 surrounding the fur bundle 2, or otherwise, as shown in FIG. 8, a tip portion 2*b* of the fur bundle 2 may be extruded and exposed considerably together with the tip end face 2*a* of the fur bundle 2.

The extent of exposure of the tip end face 2*a* and the tip portion 2*b* of the fur bundle 2 may be decided so as to have a desired effect corresponding to a kind of work using the brush.

EXAMPLE

Figure 9:
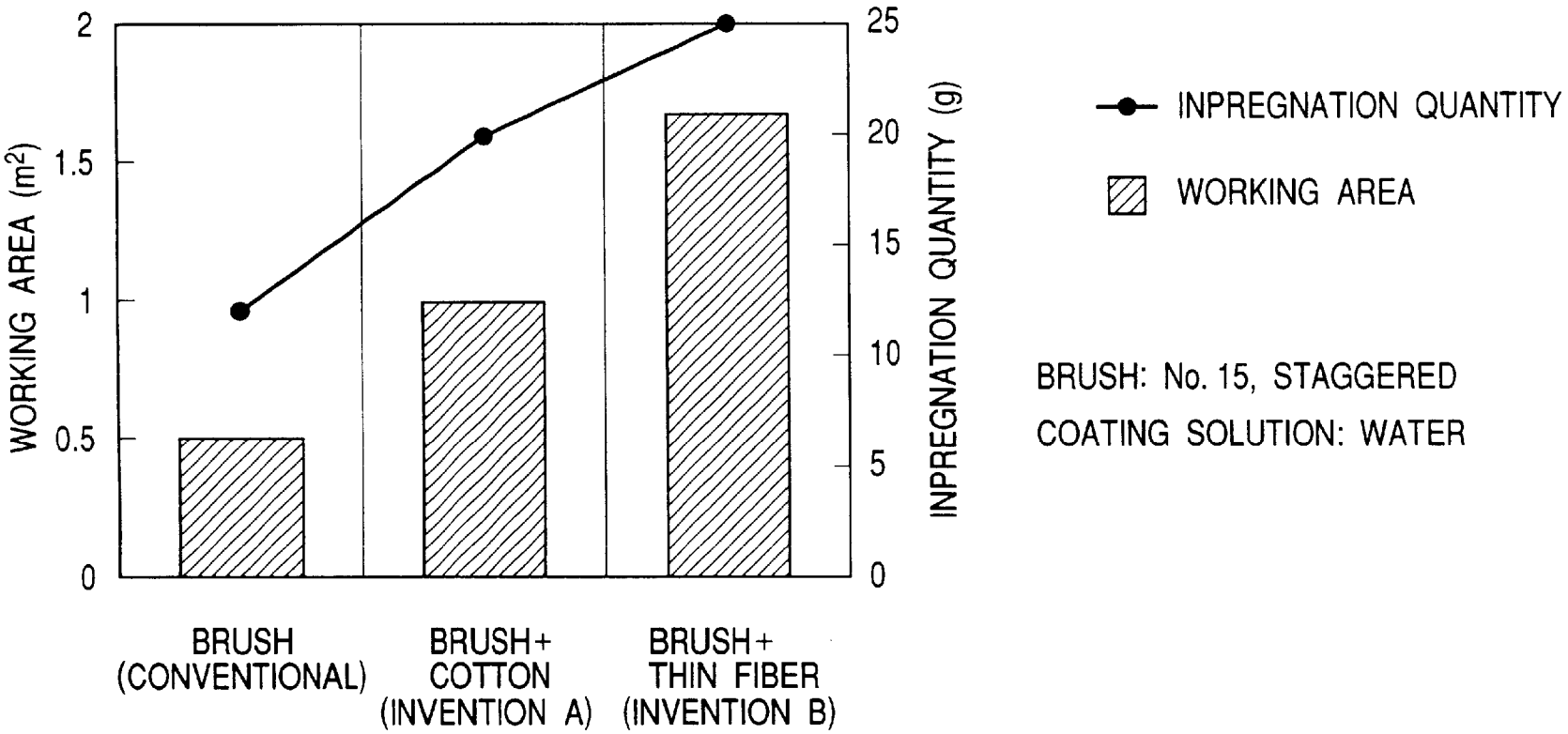
FIG. 9 is a graph showing the result of a performance comparison test between the brush according to the invention and the conventional brush.
Figure 10:
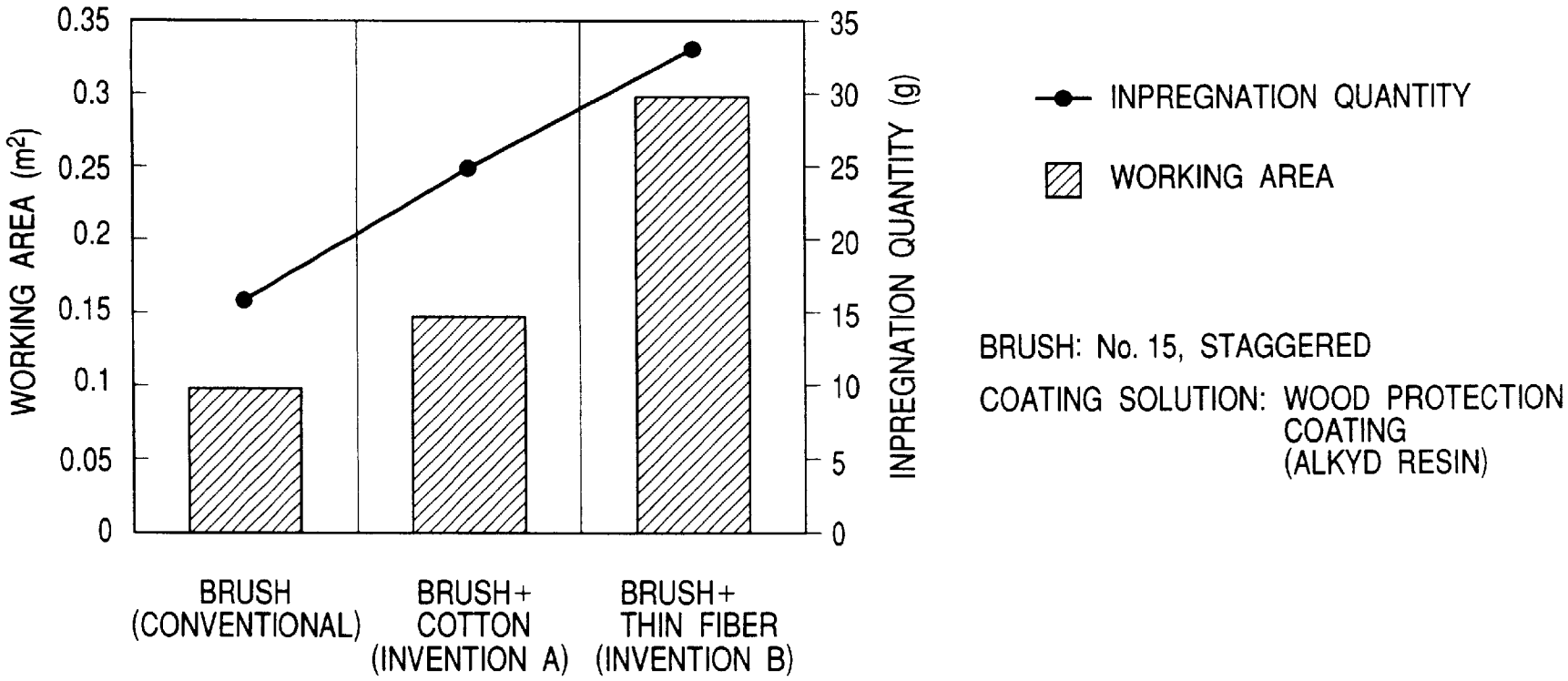
FIG. 10 is a graph showing the result of another performance comparison test between the brush according to the invention and the conventional brush.

When the brush according to the present invention was used as a coating brush, a comparison test of coating areas and impregnation quantities of coating solutions between the conventional coating brush and the brush according to the present invention was conducted, and the result thereof is shown in FIGS. 9 and 10, in the form of a broken line graph with respect to the impregnation quantities of the coating solutions and in the form of a histogram with respect to the coating areas.

The experiments were conducted under the following coating conditions.

1. Coating method: manual brushing
2. Kind of coating brush: No. 15, horse fur, staggered brush
3. Conditions of brush ends
   - i. Conventional product: brush only, without any additional thing
   - ii. Invention A: brush+cotton white material wound one round
   - iii. Invention B: brush+super fine fiber wound one round
4. Coating solutions
   - i. Tap water
   - ii. Alkyd resin low viscosity coating material (viscosity: Arnest Iwata viscosity cup NK-2, about eight seconds at 20° C.)
5. Surface for coating
   - i. Tap water: acrylic emulsion finished vertical wall surface
   - ii. Alkyd resin low viscosity coating material: imitation paper vertical wall surface FIG. 9 shows the case where the tap water is used as the coating solution and FIG. 10 shows the case where the alkyd low viscosity coating material is used as the coating solution. As is apparent from the two graphs showing the test results, both Invention A and Invention B exhibit the larger impregnation quantities and the larger coating areas for the both cases of the tap water and the alkyd low viscosity coating material being used as coating solutions, to show that the performance as the coating brush of the invention is much higher than the conventional brush. In particular, the performance of the Invention B, which the super fine fiber is wound around, is very high to be a brush having a remarkable performance with a simple structure.

The present invention is embodied as described above and has the following advantages.

Since the brush body is formed with the circumference of the fur bundle being surrounded with the fabric, in particular, the super fine fiber and the tip end face of the fur bundle being extruded and exposed, the liquid impregnation ability of the brush body is considerably enhanced without degrading the inherent function of the brush. It is possible to provide a brush in which the coating surface is kept well and the working area by one brush operation is large. The brush is suitable for coating and even unskilled person may use the brush readily with excellent quality and performance.

Also, since the brush segment is formed with the circumference of the fur bundle being surrounded with the fabric material and the tip end faces are extruded and exposed, and a plurality of the brush segments are implanted to form the brush body, the liquid impregnation ability of the brush segments is enhanced to hold the liquid cleaning agent or liquid polishing material well. Also, the fur tip end and the fabric material portion are brought into strong contact with the working surface. Thus, it is possible to provide a brush that is superior in scraping force or polishing force.

What is claimed is:

1. A brush, comprising:

a brush body including:

at least one fiber bundle formed from a plurality of elongated parallel fibers, and a fabric material forming an open ended sleeve surrounding said fiber bundle such that only a tip end face of said fiber bundle protrudes from the end of said fabric sleeve and is exposed, wherein:

each of said fibers protrudes from said open end of said fabric sleeve a distance equal to a small fraction of the length of said elongated fibers.

2. The brush according to claim 1, wherein:

said fabric material is a fabric material made of super fine threads.

3. A brush comprising:

a brush body including:

at least one fiber bundle formed from a plurality of elongated parallel fibers, a fabric material forming an open ended sleeve surrounding said fiber bundle such that only a tip end face of said fiber bundle protrudes from the end of said fabric sleeve and is exposed, the fabric material functioning to absorb paint, contact to an object surface to be painted, and apply the paint absorbed therein to the surface, and each of said fibers protrudes from said open end of said fabric sleeve a distance equal to a small fraction of the length of said elongated fibers.

* * * * *